US008020250B2

(12) United States Patent
de Bree

(10) Patent No.: US 8,020,250 B2
(45) Date of Patent: Sep. 20, 2011

(54) ARTIFICIAL TURF CLEANING

(75) Inventor: Cornelis Hermanus Maria de Bree, Driebergen (NL)

(73) Assignee: Redexim Handel-en Exploitatie Maatschappij B.V., Zeist (NL)

( * ) Notice: Subject to any disclaimer, the term of this patent is extended or adjusted under 35 U.S.C. 154(b) by 0 days.

(21) Appl. No.: 12/514,667

(22) PCT Filed: Nov. 15, 2007

(86) PCT No.: PCT/NL2007/000285
§ 371 (c)(1),
(2), (4) Date: Jun. 30, 2009

(87) PCT Pub. No.: WO2008/060145
PCT Pub. Date: May 22, 2008

(65) Prior Publication Data

US 2010/0037419 A1 Feb. 18, 2010

(30) Foreign Application Priority Data

Nov. 16, 2006 (NL) ..... 1032885

(51) Int. Cl.
*A47L 5/14* (2006.01)

(52) U.S. Cl. ..... 15/346; 15/340.3

(58) Field of Classification Search ..... 15/346–349, 15/340.1, 340.3, 340.4
See application file for complete search history.

(56) References Cited

U.S. PATENT DOCUMENTS

| | | | | |
|---|---|---|---|---|
| 4,754,521 | A * | 7/1988 | Zoni | 15/340.1 |
| 4,884,313 | A * | 12/1989 | Zoni | 15/340.3 |
| 6,195,837 | B1 * | 3/2001 | Vanderlinden | 15/348 |
| 2003/0037388 | A1 | 2/2003 | Feyma et al. | |

FOREIGN PATENT DOCUMENTS

| | | |
|---|---|---|
| DE | 3703865 | 8/1988 |
| DE | 4408247 | 9/1995 |
| WO | WO 2006/046863 | 5/2006 |

OTHER PUBLICATIONS

International Search Report for corresponding PCT Application No. PCT/NL2007/00285 dated Mar. 20, 2008.
International Written Opinion for corresponding PCT Application No. PCT/NL2007/00285 dated Mar. 20, 2008.

* cited by examiner

*Primary Examiner* — Dung Van Nguyen
(74) *Attorney, Agent, or Firm* — Knobbe Martens Olson & Bear LLP

(57) ABSTRACT

The invention relates to a device for cleaning a ground surface of artificial turf with filler, comprising a frame, moving and supporting means arranged on the frame for the purpose of moving the device over the ground surface, and processing means arranged on the frame for processing a flow of material taken up from the ground surface, such as dirt and filler, wherein the processing' means comprise: a take-up means, a separating means, a collecting means, a feedback means. The invention is characterized in that the processing means further comprise a dust suction device, wherein the dust suction device comprises at least a pump means for creating an under-pressure and a dust inlet which is connected to a suction side of the pump means and which is arranged in the vicinity of the separating means in the device.

2 Claims, 2 Drawing Sheets

ARTIFICIAL TURF CLEANING

RELATED APPLICATIONS

Figure 1:
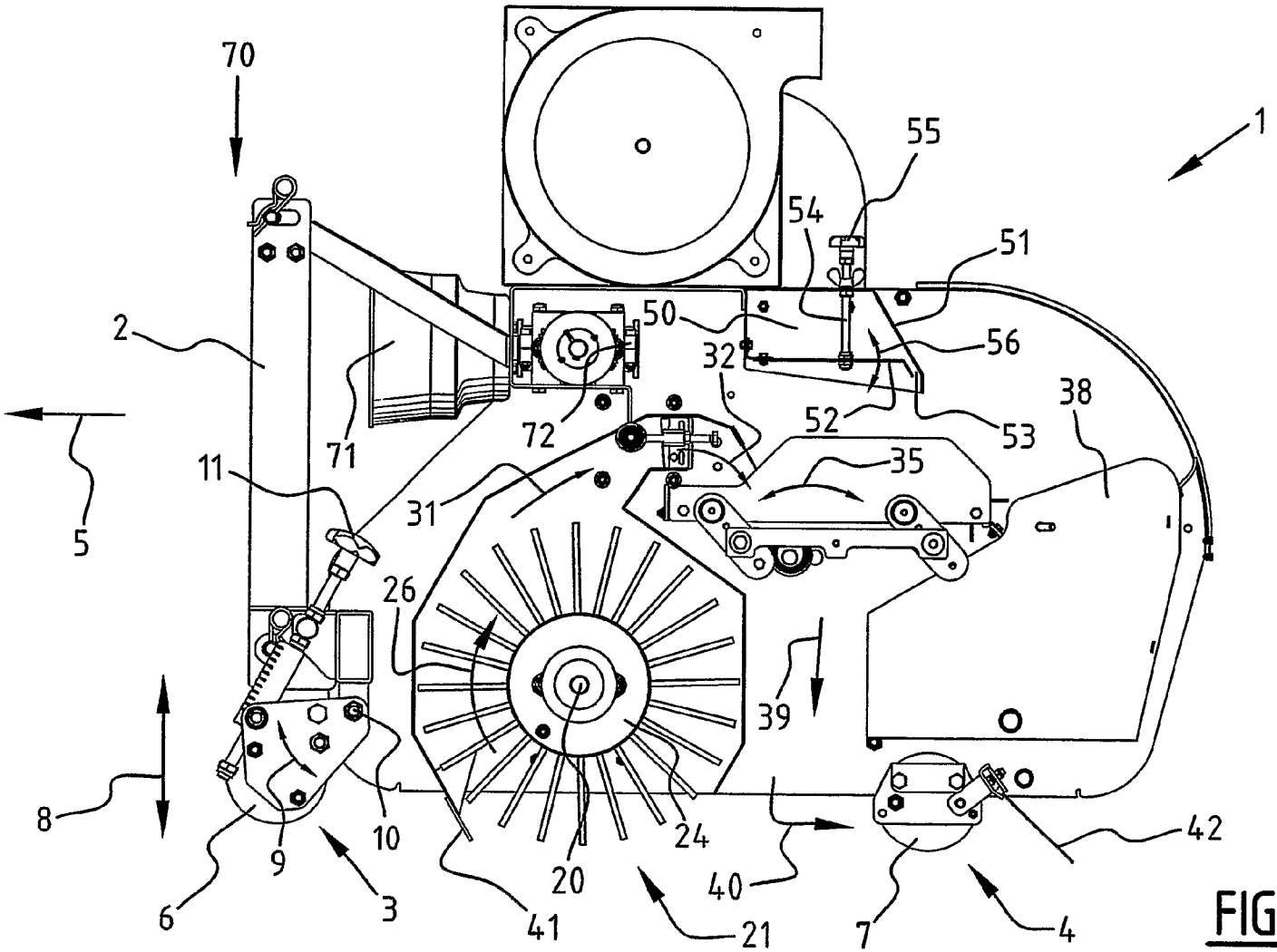

This application is the U.S. National Phase under 35 U.S.C. §371 of International Application No. PCT/NL2007/000285, filed Nov. 15, 2007, designating the U.S. and published in English on May 22, 2008 as WO 2008/060145, which claims priority under 35 U.S.C. §119(a)-(d) to Netherlands Patent Application No. NL1032885, filed Nov. 16, 2006. The content of these applications is incorporated herein by reference in their entireties.

The invention relates to a device for cleaning a ground surface of artificial turf with filler. The invention relates particularly to a device for cleaning the filler arranged between the artificial turf and to the removal of dirt present on the ground surface of artificial turf.

The mechanical cleaning of a field with artificial turf is known from the prior art. Due to further development of artificial turf, such fields are being applied increasingly more often and used increasingly more frequently. There is a growing demand for mechanical cleaning of such fields.

A problem in the mechanical cleaning of artificial turf fields is that the filler which is used between the artificial turf must not be displaced, or hardly so, while the dirt which can be situated on the artificial turf or in the artificial turf must be removed. The filler can consist of sand or rubber granules arranged between the plastic blades of the artificial turf. Various solutions are known from the prior art.

The invention relates particularly to a device which is suitable for moving over the ground surface, either with its own drive means or pulled therein by a tractor or the like. The device is provided with its own power source or can be coupled to the tractor via a drive rod. The power is required for driving the diverse components on the device for cleaning artificial turf.

The device for cleaning artificial turf is provided with moving and supporting means which are mounted on the frame with which the device can be moved over the ground surface. It is possible here to work in strips, and these strips are cleaned. A surface can hereby be cleaned. The device preferably has a determined width perpendicularly of the direction of movement, wherein the processing means for cleaning the field accommodated in the device clean a strip or path corresponding more or less to the width of the device.

The invention relates particularly to the removal of small dust particles. It is a known problem in the prior art that cleaning of artificial turf results in the generation of clouds of dust and the like.

The object of the invention is to provide a device in which this dust problem is reduced. This objective is achieved with a device provided with processing means for processing a flow of material taken up from the ground surface. The material that is taken up is the dirt and the filler. The flow of material is created so that it can be processed in the machine. Different successive processes can be carried out here.

According to the preferred embodiment, the processing means for cleaning the ground surface preferably comprise a take-up means arranged on the frame, wherein the take-up means is adapted to take up material from the ground surface. The flow of material through the device begins at this take-up means. The take-up means can impart kinetic energy to the material, filler and dirt so that the flow of material results.

The processing means preferably further comprise a separating means such as a grating arranged downstream of the take-up means for the purpose of separating the filler from the taken-up material. A separating means has a feed and at least two discharges. The separating means is adapted to guide material with a first property to a first discharge and material without the first property to a second discharge. The separation can take place with a grating. A distinction is made here on the basis of size, in particular diameter of the material. This is a known manner for separating filler from dirt.

The processing means further comprise a collecting means arranged downstream of the separating means close to a discharge of the separating means for the purpose of collecting dirt, in particular large dirt parts such as leaves and the like, which may be present on the ground surface of artificial turf as fouling. In addition, the processing means comprise a feedback means arranged downstream of the separating means, preferably close to a first discharge thereof, for feedback to the ground surface of filler which has been separated in the separating means.

The invention reduces the nuisance which can result from dust in that the device further comprises a dust suction device which is at least provided with a pump means for creating an underpressure and with a dust inlet which is connected to the suction side of a pump means and which is arranged in the vicinity of the separating means in the device. A device is hereby obtained wherein the dust is preferably dislodged when the taken-up material comprising filler and dirt is processed in the separating means. A flow of filler is created at a separating means which is fed back to the ground surface, and a flow of larger dirt, which is guided to the collecting bin. A large amount of dust results during this separation which can be removed or can be collected via the dust inlet by means of the dust suction device. Owing to the placing close to the separating means, the greatest possible amount of dust is captured in efficient manner and at low power. Because operation is oriented toward the separating means, a balance is found in efficient manner between increasing the power of this device in general by adding extra dust suction devices, and a reduction in the amount of dust.

According to a preferred embodiment the device comprises a processing chamber to which the material taken up from the ground surface is supplied. The grating of the separating means herein forms a wall of the processing chamber, and this processing chamber is further provided with a discharge to the collecting means. A processing chamber is hereby obtained in which all the taken-up material is in the first instance collected before being guided to one of the three discharges. The filler is discharged through the grating, back to the ground surface, larger parts of the dirt, such as leaves, are collected in the collecting bin and smaller constituents are guided to the dust suction device at the dust inlet. According to the invention an equilibrium can be found in the chamber for the force fields acting on the material guided into the processing chamber. Use is preferably made of the force of gravity to allow the filler to fall through the grating. The same force of gravity ensures that larger dirt parts remain lying on the grating, and this dirt can be guided in the discharge direction into the collecting bin via a force field, preferably via for instance a shaking movement. Smaller parts present in the processing chamber, such as dust, will "swirl" in the processing chamber and can be extracted by means of a pump means.

In a preferred embodiment the dust inlet is formed by a gap extending in a width direction of the device transversely of the direction of movement. The gap extends transversely of the length direction of the strip of artificial turf for cleaning. Using such a gap the dust extraction can be achieved over a determined area, preferably in width direction of the device, and extraction is obtained which is substantially constant in this width direction. A plurality of gaps can however be arranged adjacently of each other in the width direction.

The grating of the separating means preferably extends in a width direction of the device, and the gap is similarly formed and extends in the same width direction. A uniform extraction is hereby achieved over the full width of the grating.

The size of the gap is preferably adjustable. The degree of extraction can hereby be adjusted. The equilibrium prevailing in the processing chamber can particularly be influenced hereby. At a constant underpressure, which is obtained with the pump means, a higher suction speed can be obtained by making the gap smaller.

In a particular embodiment the gap is formed between a wall part and a hinged flap. The hinged flap can be adjusted by a user by means of a turnbuckle or rotating hinge. A robust assembly is hereby obtained for the dust inlet gap. In a preferred embodiment the wall part forms part of a distribution chamber placed between the suction sides of the pump means and the dust inlet. The underpressure obtained with the pump means can be adjusted in the distribution chamber, thereby achieving uniform suction. The hinged flap can be a movable part of the wall of the distribution chamber.

In a preferred embodiment the separating means is formed by a shaker screen. The shaker screen is preferably connected movably to the frame. A drive for the shaker screen can set the grating into movement relative to the device. A shaking movement is hereby obtained, wherein the fillers of the artificial turf are detached from dirt which may be caked thereon, such as leaves, whereby the fillers can fall through the grating and guided via the feedback back to the ground surface. The shaker screen preferably executes a reciprocal movement.

In a preferred embodiment the separating means, in particular the grating or the shaker screen, is arranged tiltably in the device. The degree of cleaning can hereby be adjusted. By tilting the shaker screen, with the supply side lower than the discharge side in the direction of the collecting bin, an inclination is obtained whereby dirt is less likely to be guided to the collecting bin, whereby a better cleaning takes place. In another embodiment a movable flap can be arranged between separating means and collecting bin, which flap forms a threshold for the discharge in the direction of the collecting bin, whereby the dirt remains in contact longer with the separating means and a better cleaning is obtained.

It is advantageous to embody the take-up means as a brush accommodated in the device and bearing-mounted on the frame. The brush is rotatable and can here be driven via an external or internal power source. The brush is preferably placed transversely of the direction of movement of the device. The brush herein rotates around its shaft over the artificial turf in a direction of movement opposite to that of the device, whereby dirt and filler on the ground surface of artificial turf can be swept up. During the sweeping the dirt and filler can be collected in the processing chamber arranged downstream of the brush. Preferably formed around the brush is an arcuate wall part which is adapted to guide the swept-up material from the ground surface to the processing chamber.

It is particularly advantageous to embody the device with a transmission which is coupled to the take-up means, the pump means and the separating means. The various components of the device can be driven via a single power source. The transmission provides for the correct rotation speeds, since a pump means operates at a higher rotation speed than the brush, and the brush at a higher rotation speed than the separating means, such as the shaker screen.

It is further advantageous for the device to comprise coupling means for coupling the device to a drive vehicle. An external power source can be coupled to the device via the coupling means, in particular a drive rod.

Figure 2:
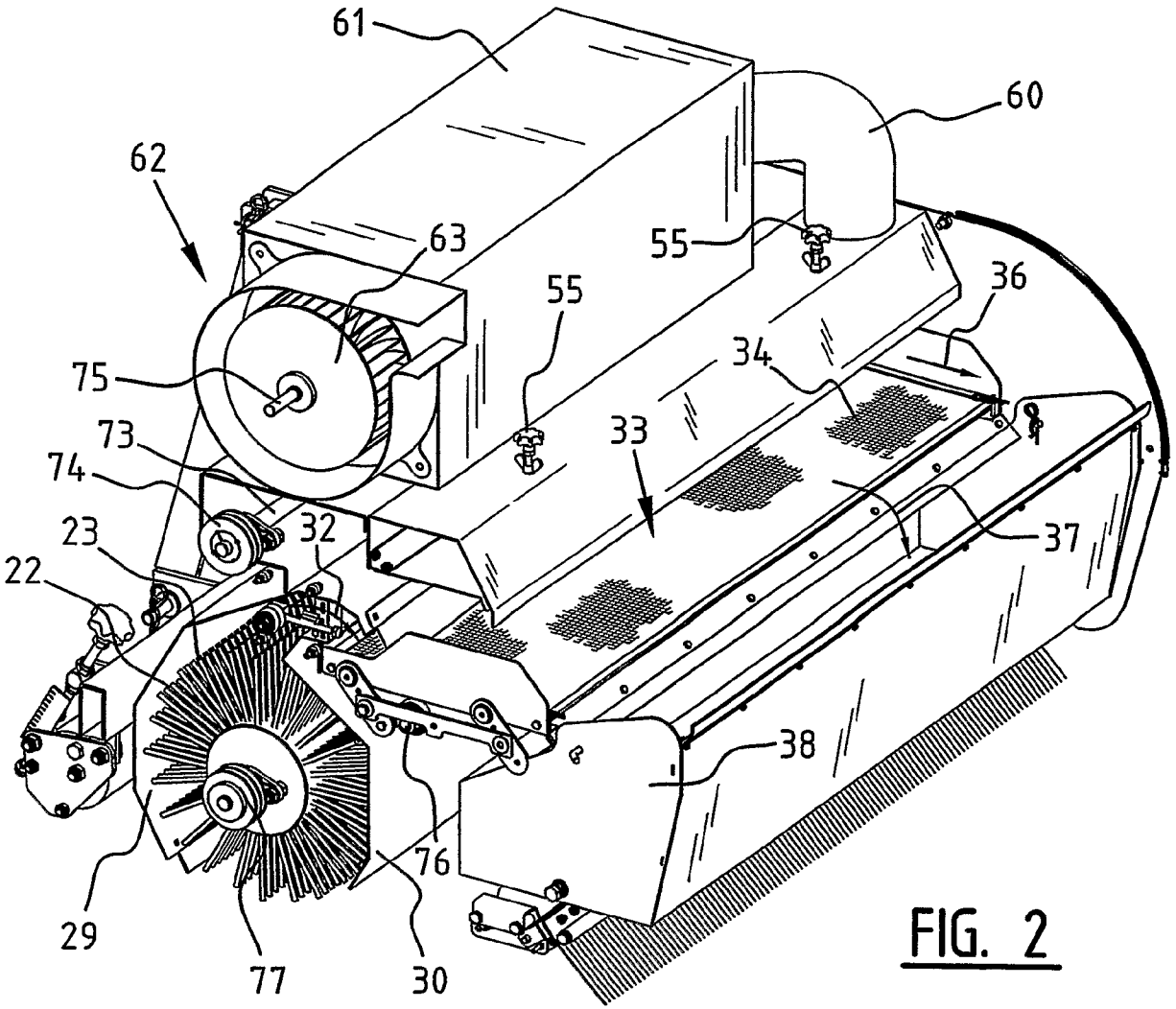

The invention will be further described with reference to the accompanying drawings, in which:

FIG. 1 shows a side view of the first embodiment according to the invention, and FIG. 2 shows a perspective top view of a device of a first embodiment according to the invention.

The same components are designated in the figures with the same reference numerals.

FIG. 1 shows a cross-section of a device 1 according to a first embodiment. Device 1 comprises a frame 2 on which are arranged moving means 3,4 with which device 1 can be moved over a ground surface (not shown) of artificial turf with filler in direction of movement 5. The moving means comprise two bearing-mounted wheels 6,7. Wheels 6,7 can be connected movably to frame 2 so that a degree of adjustment is possible for deep-cleaning of the artificial turf. The mobility allows a movement in the height direction as according to arrow 8. A tilting around hinge 10 as according to arrow 9 can be achieved here by adjusting rotary knob 11.

A brush 21 is connected to frame 2 bearing-mounted around a shaft 20. Brush 21 comprises a large number of rods 22,23 connected to a cylinder 24 of brush 21. These tufts 22,23 are possibly replaceable. Brush 21 can rotate around shaft 20 as according to arrow 26. Brush 21 herein moves over the ground surface in a direction opposite to direction of movement 5.

The brush is a take-up means which is arranged between two wall parts 29,30 of the frame which form a substantially circular receiving space. When the brush is rotated as according to arrow 26, material from the ground surface, such as filler and dirt, will be carried as according to arrow 26 into the receiving space between wall parts 29 and 30 and fed to the interior of the device as according to arrow 31.

The material guided between the wall parts of the device as according to arrow 31 will be carried further as according to arrow 32 onto the separating means embodied in this embodiment as shaker screen 33. The shaker screen comprises a grating 34. Shaker screen 33 is connected to the frame in bearing-mounted manner and can herein move as according to arrow 35. Shaker screen 33 executes a reciprocal movement.

The material with dirt will be guided onto the shaker screen and will be guided at least partially over grating 34 as according to arrow 36 by the movement of the shaker screen. Larger parts of the dirt will be guided as according to arrow 37 into collecting bin 38, in which larger parts of the dirt is collected. The filler taken up in the flow of material as according to arrows 31 and 32 has a size such that it can fall through grating 34 as according to arrow 39 and is thus fed to the ground surface as according to arrow 40.

Placed close to the inlet, which is formed close to take-up means 21, is a flap 41 which will guide the material inward as according to arrow 31. The material fed back as according to arrow 40 is carried onto the ground surface, and a second flap 42 connected to the frame presses the filler back down between the artificial turf.

Further accommodated in device 1 at a determined short distance immediately above shaker screen 33 is a distribution chamber 50 with a fixed wall part 51 and an adjustable wall part 52, between which a gap 53 is formed. The adjustable wall part 52 is coupled via a shaft 54 to a rotary knob 55 with which the flap can be moved as according to arrow 56, whereby gap 53 has acquired an adjustable size. Gap 53 is oriented in the direction of grating 34 of shaker screen 33. Due to the movement of shaker screen 33 dust will be released, which "swirls" in the space above the shaker screen, between the feed as according to arrow 32 and the discharge as according to arrow 37. This dust can be suctioned into chamber 50 via gap 53. Chamber 50 is connected via a pipe 60 to a housing part 61 which is arranged on the device and which is for instance provided with a dust bag. The dust bag has a fine-mesh structure and can occupy the whole housing 61. A suction side of the schematically shown pump 62, the bearing-mounted fan 63 of which is visible, is connected to housing 61 and can create an underpressure in housing 61 and, via pipe 60, in chamber 50. This takes place through the centrifugal action of fan 63.

The dust bag arranged in housing 61 can be replaced easily and can be replaced with an empty dust bag after use when housing 61 is opened.

Device 1 can be coupled to a tractor at the front 70. A coupling can also take place here via a drive rod which is received in sleeve 71 and which is coupled to shaft 73 via a transmission 72. The wheel 74 arranged on shaft 73 can be engaged by belts (not shown). The belts couple wheel 74 to shaft 75 of pump means 62, to the wheel 76 coupled to shaker screen 33 and the wheel 77 arranged on shaft 20, which is coupled to brush 21. The various components of the device are driven via this one joint transmission. The transmission can hereby be performed by the belts, in particular via wheels 74,75,76,77, in a manner such that an adjustment of the rotation speed of shaft 73 herein takes place. Use is particularly made here of a transmission which drives the pump of the dust suction device at about 3500 rpm, wherein the brush is driven at about 700 rpm and the screen at about 200-250 rpm.

Use can be made as dust bag of a collecting bag as known from industrial applications, for instance from wood dust extraction, which are moisture-resistant. Use can be made here of an exchangeable bag, this bag being provided with pores with a size of 10 μm.

Although the invention is shown on the basis of a preferred embodiment, it will be apparent to the skilled person that different embodiments are possible within the scope of the invention.

The invention claimed is:

1. A device for cleaning a ground surface of artificial turf with filler, comprising:

a frame, moving and supporting means arranged on the frame for the purpose of moving the device over the ground surface, so as to process a flow of material taken up from the ground surface, said material comprising dirt and said filler, a take-up means arranged on the frame for taking up material from the ground surface into the device, a grating, wherein said grating is arranged downstream of the take-up means for separating the filler from the taken-up material, a collecting means arranged downstream of the grating for collecting the dirt, a feedback means arranged downstream of the grating for feedback of the separated filler to the ground surface, and a dust suction device, wherein the dust suction device comprises at least a pump means for creating an underpressure and a dust inlet which is connected to a suction side of the pump means, wherein said dust inlet is formed by a gap oriented toward the grating, and wherein the gap has an adjustable size.

2. The device of claim 1, wherein the gap is formed between a wall part and a hinged flap.

* * * * *